US009631892B1

(12) United States Patent
Salvitti et al.

(10) Patent No.: US 9,631,892 B1
(45) Date of Patent: Apr. 25, 2017

(54) PISTOL GRIP KNIFE

(71) Applicants: Alfred W. Salvitti, Glen Riddle, PA (US); Nico Salvitti, Glen Riddle, PA (US)

(72) Inventors: Alfred W. Salvitti, Glen Riddle, PA (US); Nico Salvitti, Glen Riddle, PA (US)

( * ) Notice: Subject to any disclaimer, the term of this patent is extended or adjusted under 35 U.S.C. 154(b) by 197 days.

(21) Appl. No.: 13/998,835

(22) Filed: Dec. 13, 2013

Related U.S. Application Data

(60) Provisional application No. 61/797,761, filed on Dec. 14, 2012.

(51) Int. Cl.
*B26B 3/00* (2006.01)
*F41B 13/08* (2006.01)

(52) U.S. Cl.
CPC ..... *F41B 13/08* (2013.01)

(58) Field of Classification Search
CPC ..... B23D 59/006; B23D 29/06; F41B 13/08
USPC .... 30/342, 286, 232, 314, 351; D8/105, 107
See application file for complete search history.

(56) References Cited

U.S. PATENT DOCUMENTS

| | | | | | |
|---|---|---|---|---|---|
| 2,389,882 | A * | 11/1945 | Wood, Jr. | F41B 13/08 30/151 |
| D257,056 | S * | 9/1980 | Spivey | D22/118 |
| D392,016 | S * | 3/1998 | Balolia | D22/118 |
| D464,551 | S * | 10/2002 | Glesser | D8/98 |
| 6,658,743 | B2 * | 12/2003 | Dudley et al. | 30/314 |
| D495,772 | S * | 9/2004 | Hibben | D22/118 |
| 8,726,522 | B2 * | 5/2014 | Lin | 30/232 |

* cited by examiner

*Primary Examiner* — Omar Flores Sanchez
(74) *Attorney, Agent, or Firm* — Robert B. Famiglio; Famiglio & Associates

(57) ABSTRACT

The device discloses a thrusting knife of improved design which provides for an angled handle to allow more natural thrusting movements in hand to hand combat situations. The knife is comprised of a pistol grip-like handle which is more natural for a user to hold and provide a striking action with more natural wrist position when in use. The invention is more readily adaptable by individuals already trained in fist fighting tactical pistol drawing and placement or other self defense or combat arts. An index finger opening at the interface of the pistol grip and blade provide for improved control. An alternate embodiment is configured for use with a gloved hand.

2 Claims, 2 Drawing Sheets

PISTOL GRIP KNIFE

CROSS REFERENCE TO RELATED APPLICATIONS

The Applicants claim the benefit of the provisional patent application No. 61/797,761 filed on Dec. 14, 2012.

BACKGROUND OF THE INVENTION

Field of the Invention

The invention relates to knives, specifically non-folding knives which have a fixed blade attached to a curved pistol grip-like handle. The invention is specifically used as a close quarter combat fighting knife.

Related Background Art

The use of knives or other edged or blade instruments are commonly used as a fighting weapon for self defense, military use or application by special services soldiers. Edged weapons are older than most fighting weapons and predates the age of firearms. Most edged weapons are comprised of relatively straight blades whose handle is part of a single tang which is used in the formation or construction of the edged weapons. A handle for a single or double edged fighting blade is typically inline with the tip of the blade being coaxial with the center line of the blade itself. However, these traditionally styled or shaped fighting blades require the user to grasp the blade such that in a normal, comfortable stance, the blade will be pointed either up or down as a user extends his arm forward with the user's hand clasping the knife handle in a conventional position and naturally extended fist pointed in line with the arm and wrist.

Because of this, techniques used in training for combat operatives and individuals learning self defense with an edged weapon are taught in a fashion which is less effective, comfortable and natural than that person who may have handled a firearm which uses a pistol grip-like appendage from the weapon. Many people are used to pointing a pistol or certain types of rifles or other firearms that use a pistol grip. The grip is typically angled away from the center line of the firing end of the firearm which projects the bullet towards the intended target. For many people who have been trained with firearms for self defense or military use, it is a normal and natural progression to point a pistol or a rifle with a pistol grip at the intended target in a natural stance.

Knives and other edged weapons typically do not present this type of ergonomic situation to the user. Accordingly, it would be more natural for a user to have an edged weapon or a knife which presents a pistol grip-like handle such that the point of the weapon can be thrust forward toward the intended target while the user is maintaining a natural and comfortable grip, much like the grip of a small side arm or pistol that the user may already be comfortable in using.

More particularly, it would be desirable to design an edged fighting weapon which can be handled by the user in a manner or fashion simulating the drawing of, and thrusting forward of a pistol handgun so that muscle memory and training techniques will be familiar to the user. Many military training programs including special forces, law enforcement special operations and the SWAT teams, and self defense security training frequently spend considerable time on teaching the fundamentals of drawing a pistol from a side holster, bringing it up towards the chest and thrusting outward to point the weapon at the target. It would be desirable to capitalize on such well known training techniques and translate those techniques to an effective use of an edged fighting weapon so that in high stress situations a trained user could rely on both pistol drawing and pointing and manual hand to hand combat techniques and apply them directly to the operation of an edged fighting weapon.

Most knives, whether a combat or fighting knife, a kitchen knife or other similar implement, have in common the same parts. Beginning at the farthest end of the knife from what would be considered a handle, the tip of the knife is the forward part of the knife and includes the knife point. While the tip is used for detailed or delicate cutting, the knife point is a part of the knife where the edge and the spine come together and is used for piercings such as in a forward thrusting action when using the knife. The edge of a knife is the cutting part of the blade and typically extends from the point to the heel of the knife. The heel is the rear part of the edge opposite the point discussed above.

Some knives can have an area called the spine which is the top of the knife blade opposite the knife's sharp edge. However, many combat or defensive knives, such as in the present invention, have an edge added to both sides of the blade extending from the point all the way to the heel. The bolster of a knife is the band that joins the blade of the knife to its handle. A bolster can provide balance to the knife and also helps protect the hand from getting in the way of the knife's edge by limiting travel of the hand sliding forward when it is grasping the handle. The tang is the part of the blade that extends into the handle of the knife. The tang is typically the surface to which the handle attaches to the blade that allows a comfortable grip. Quality knives of better design have a single tang in which the tang is actually the same piece of steel or other metal used to fabricate the entire knife from point to butt. The butt is the end of the handle of the knife at the opposite location on the knife from the point. Some knives have scales which are the part of the knife that creates a comfortable handle wrapped about the tang. Scales sometimes are made of synthetic material or wood as one might see in a traditional knife. Two scales are typically attached to the tang with rivets on either side to create a grip around the handle. Some knives forego separate scales and fashion the tang to have an integrated handle allowing a firm grip. Some knives incorporate a cross guard or hand guide to protect the fingers holding the knife in a hand.

The many different styles of edged weapons and fighting knives do not yield or demonstrate an edged fighting weapon which will allow a user to more readily learn self defense tactics or military techniques in using edged weapons that are similar to any experience that user has with a firearm. What is needed is a new design in an edged weapon to allow the application of a more natural pointing and thrusting instinct of the user such that the user may be taught more quickly and more effectively to use an edged weapon in very close quarters combat.

SUMMARY OF THE INVENTION

The disclosed invention provides an edged fighting weapon with an integral pistol grip to allow the user to more comfortably handle the edged weapon as it is thrust forward in the use as a combat device or self defense weapon. The knife disclosed is most readily deployed as a thrusting weapon effective for military tactics and self defense taught to military operatives and other special trainees.

The invention takes advantage of an index finger retention hole between the base of the blade such as to provide comfortable finger engagement by the user's hand by providing a firmer grip of the knife. The angle of the pistol grip handle in relation to the center axis of the knife blade is designed to simulate the handling and feel of a handgun firearm so that handgun skills of the user will immediately translate to the operation of the invention with the same muscle memory and forward thrusting activity as one would be training a handgun upon a target.

An improvement to the invention includes a contrasting forward sighting area which is designed to simulate the front sight normally found on the top of a barrel of a handgun allowing one or two eye sighting as the knife is thrust forward, much as a handgun user is trained to look down the top of the barrel of a handgun while thrusting it forward to the firing position.

It is therefore the object of the present invention to provide a design for an improved combat and fighting knife. It is further the object of the present invention to provide a knife design specifically for combat fighting through thrusting motions whereby the user can hold the knife with a pistol grip-like stance allowing a natural forward thrusting of the weapon.

It is yet another object of the present invention to provide an improved method of engaging in hand to hand combat with an edged weapon which provides forward thrusting similar to boxing thrusts.

It is also the object of the present invention to provide a knife designed to take advantage of drawing and aiming techniques learned in tactical pistol firearms training.

DETAILED DESCRIPTION OF THE INVENTION

Figure 1:
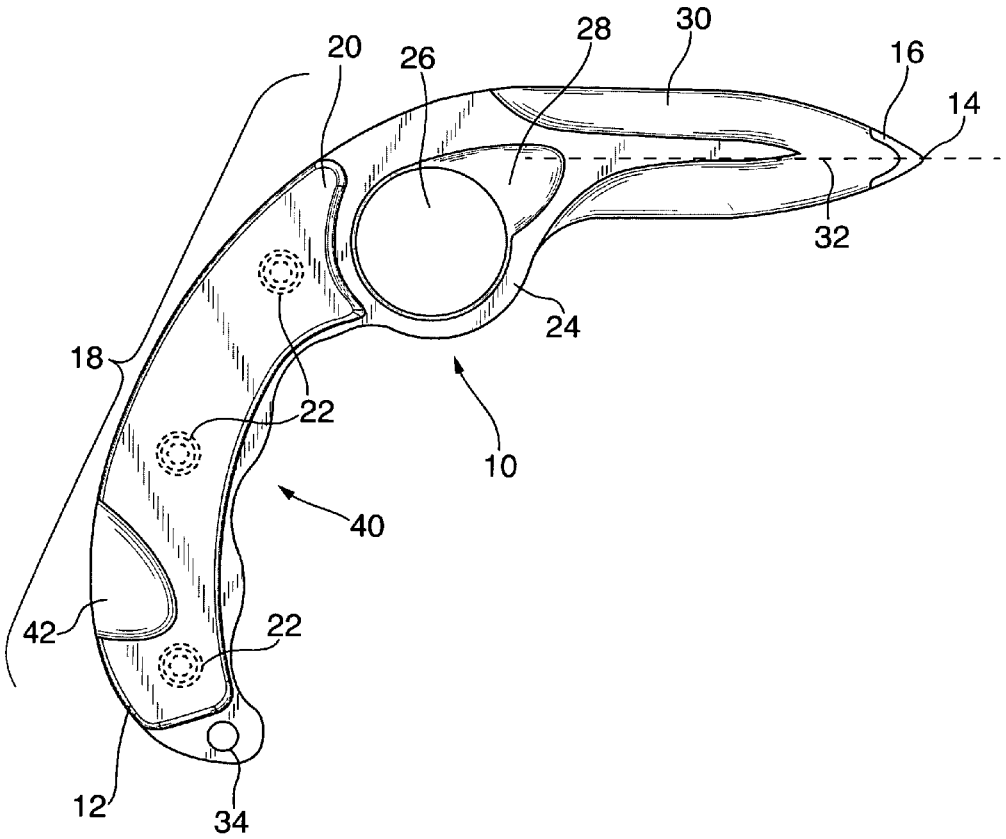
FIG. 1 is a side view of the invention in its basic embodiment.

And now the invention will be described in detail with reference to the various figures wherein like numerals describe like parts. Two embodiments of knife 10 are shown in various views in the several figures. Knife 10 is forged or otherwise created from a single piece of steel angled in a fashion such that the tang of the knife is in the basic form of a pistol grip 18 whereby the hand of the user of knife 10 grasps grip 18 in a comfortable grasp as if the user of knife 10 is holding a firearm pistol. Tang 12 is comprised of undulations 40 such as to provide a comfortable grasp for the user's hands.

Blade point 14 is centered around blade center axis 32 with blade 30 containing sharpened edges on each side of the blade. Tang cover 20 acts as an enhancement to pistol grip 18, each cover bolted through tang 12 with tang cover fasteners 22. Index finger ring 26 is a hole or opening through the shoulder area where blade 30 meets handle 18 to allow the index finger to be placed therethrough when gripping the knife. Ring 26 is formed by finger guard 26 which is configured like a trigger guard on a firearm.

Index finger guide 28, shown in FIG. 1, provides a means for the user to more quickly find index finger ring 26 when grasping the knife from a holster or belt sheath without the need to look at the knife while positioning it. Index finger guide 28 allows the user grasping the knife from a belt sheath to guide the user's index finger along blade 30 at approximately the blade center axis 32 similar to use of a pistol firearm when one is drawing the firearm from a holster and always taught that the trigger finger, being the index finger, should remain outside the trigger guard opening and instead aligned with the barrel of the firearm until the user is ready to fire and/or has brought the firearm to the chest area and thrust it forward in order to gain a good sight picture before firing the weapon. In a similar fashion, the present invention allows such firearm training to translate immediately to the use of the disclosed knife. A user's index finger slides rearward along blade center axis 32, coming in contact with the impression or concave area of index finger guide 28 allowing the user to feel his way by tactile senses into index finger ring or opening 26 and thereby placing the index finger, as with the trigger of a firearm, through the opening 26.

FIG. 1 also discloses tether hole 34 as well as a handle finger guide 42 which would allow proper placement of the pistol grip knife when the knife is held in an inverted fashion with the bottom of tang 12 nearest tether hole 34 being in the upright position essentially grasping knife 10 in an inverted or upside down fashion. It can be appreciated by considering the figures that even in such a reversed, inverted grip, blade center axis 32 remains in a forward position with blade point 14 pointed towards the adversary though positioned below the user's fist around which knife pistol grip handle 18 is held. In such an alternate use, the user's pinky finger would be normally extended through index finger ring 26 by sliding across finger guard 24 with the user's index finger thereby being closest to tether hole 34. Handle finger guide 42 is designed and placed on handle 18 at the lower end of tang 12 to allow easier indexing and orientation of the pistol grip knife when used in this alternative method.

Figure 2:
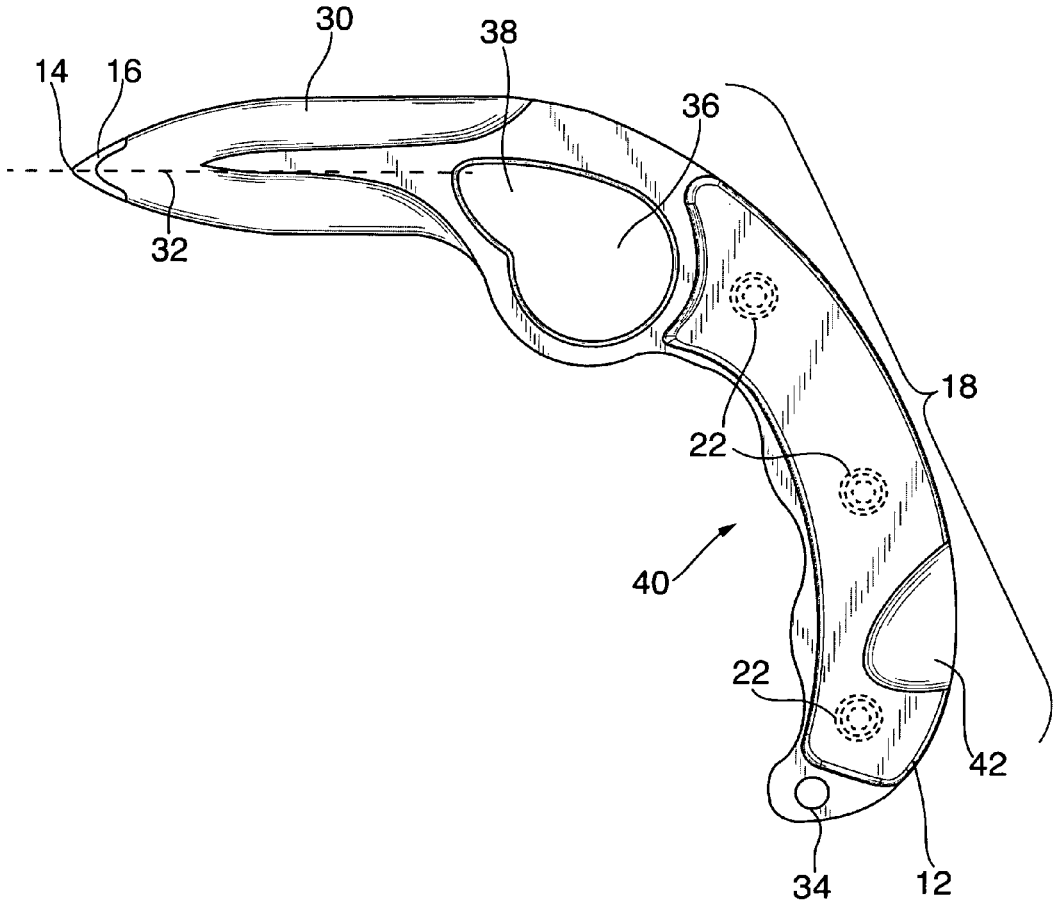
FIG. 2 is a side view of an alternate embodiment of the invention.

FIG. 2 is an alternative embodiment of the pistol grip knife whereby extended finger ring 26 is elongated in the extended finger guide area 38 by eliminating the material which is normally used as the index finger guide 28 in FIG. 1. It has been found that by extending or enlarging the opening which comprises extended finger ring 36 to include the area shown as finger guide 38, gloved hands sometimes found in service by the military or others fits more readily through finger ring 36 where one's gloved hand may not fit through index finger ring 26 shown on FIG. 1.

Continuing with FIG. 1, it can be seen that there are three undulations 40, each forming a comfortable area for the user's fingers to grasp knife pistol grip 18 while holding the knife in the intended position. It can be seen from FIG. 1 that the angle used in the preferred embodiment is approximately 45 degrees when measured between the blade center axis 32 and the average center line of pistol grip 18. It can be appreciated that this angle can be adjusted somewhat in either direction as long as the basic design provides for a comfortable handle in which the user can grip knife 10, extending the user's wrist inline with the outstretched hand such that thrusting motions with knife 10 can be generated in the forward position to pierce or thrust knife 10 without any lateral movement.

The method of fighting with knife 10 is best understood if one visualizes a straight punching action in a combat scenario where a user is thrusting one's hand forward as if to punch an opponent. By holding the knife in the clenched hand of the user as if the user was throwing a punch at an opponent, the invention presents blade point 14 as perpendicular to the opponent as possible. This is in contrast with more conventional knives in which the gripping action of the user requires the user's wrist to be at other than a straight line position with the user's forearm. Grasping a typical knife will require the user to hold the tang or handle of the knife with the knife point 14 or blade point sight 16 pointing in a vertical or downward direction when the user of a conventional knife extends when the hand grasping the knife forward as if throwing a punch. It is for this reason that conventional knives are sometimes used in a slashing action or a stabbing action from a downward thrust as opposed to a more natural punching action which is not comfortable or available for the user of a conventional knife without the design disclosed in the present invention.

Blade point sight 16 is a contrasting color such as bright white or red which acts very much in the way that a barrel sight on the end of a pistol or rifle allows the user of that weapon to line up and point the weapon towards the intended target. During a fast draw of the present invention from a holster or a sheath and drawing the knife upwardly then outwardly towards an intended target, it can be appreciated that having a bright contrasting sight-like device on the end of blade 30 directing blade point 14 is advantageous. It would not be necessary for the user of the knife to focus on the knife itself but rather the intended target while allowing the peripheral vision of the user to stay in contact with contrasting blade point sight 16 more easily. In fact, use of the present invention in a dark environment is greatly enhanced by providing that blade point sight 16, an area which may take advantage of luminescent materials to provide a night sight system somewhat similar to what one may find in firearms that use so called "night sights."

It can be appreciated that with sight 16 in the vicinity of tip 14 of blade 30, the invention can be drawn from a holster in the same fashion and with the same reflexes in training one would withdraw a firearm pistol from one's belt, drawing the knife up the strong side of the user's torso in a pistol-like tactical draw, bring the knife to the mid chest or upper torso area of the user and then thrust outward looking behind the top edge of blade 30 just as the user would also look down the barrel of a firearm as he or she extends that firearm outwardly towards the intended target.

Many firearm users would also recognize that in such a tactical stance, users will bring the opposite arm and the hand of the opposite arm to meet the strong arm and grasping hand of the knife, clasping both hands together around grip 18, thereafter thrusting knife 10 outwardly towards the intended target using the same motions of tactical pistol draw and aiming of the pistol. It has been noted that this method of use of the present invention allows fast learning by tactical operatives who are well trained in tactical pistol draw. The design of the invention, specifically with the index finger ring 26 defined by finger guard 24, being much the same as the trigger guard on a pistol, provides an excellent blending of pistol and knife fighting skills using the same biomechanical action.

One of the advantages of the present invention along with the method described in using the invention is the power of the thrust which may be placed in the action of an edged weapon such as knife 10. The biomechanical dynamics of a boxer or martial arts fighter is such that the maximum energy from a thrust in striking an opponent is realized when driving the human arm straight in a punching action towards the opponent. Although in certain martial arts and other fighting techniques, leverage and angled approaches may be used to throw an opponent off balance first, maximum energy imparted to the opponent occurs when there is a direct thrust from the arm outstretched in a punching motion directly on the opponent. Therefore, with an edged weapon properly designed as set forth in this disclosure, a punching action with the pistol grip knife 10 allows the thrust of the user to impart maximum energy through the tip 14 of knife 10 to the opponent by providing the ability of the user to thrust forward as if punching the opponent yet imparting the additional advantage of an edged weapon like knife 10. In actual use, it is seen that this direct thrusting action without twisting or angling the user's wrist outside the motion vector of the arm provides the maximum effect of the use of an edged weapon and therefore is preferred in close quarters combat.

In the embodiments of the invention disclosed, it is also beneficial to consider having a retention strap attached to knife 10 so that when the user is gripping the knife, the pistol grip-like structure of tang 12 covered by tang cover 20 can be attached to the wrist of the user by a strap attached to tether hole 34. It allows knife 10 to be attached to the user much as one may have a pistol retention strap on a firearm. Other knife retention techniques can be used if desired so that the knife would not easily be knocked away from or out of the hand of the user.

In so far as a description above and the accompanying drawing disclose any additional subject matter that is not within the scope of the claims below, the inventions are not dedicated to the public and the right to file other applications to claim any additional inventions is reserved.

What is claimed:

1. A pistol grip knife fabricated from a single tang comprising:

a handle for gripping by a user's hand, said handle being an integrated part of said tang of said knife for receiving fingers of said knife user when said user is holding said knife;

a blade extending outwardly from the handle forming an acute angle with the handle for said knife; and a finger opening located approximately at the vertex of said acute angle between said blade and handle to accept the finger of said knife user;

further including an area at the tip of said knife blade containing a contrasting color to serve as an aiming point of said knife when pointing said blade at the intended target.

2. The pistol grip knife of claim 1 wherein said contrasting area is comprised of a luminescent material to provide a sight capable of guiding the tip of said blade toward the intended target in the absence of ambient light.

* * * * *